United States Patent [19]

McGlothen

[11] Patent Number: 4,523,643

[45] Date of Patent: Jun. 18, 1985

[54] WELL PERFORATING AND COMPLETION APPARATUS AND ASSOCIATED METHOD

[75] Inventor: Jody R. McGlothen, Garland, Tex.

[73] Assignee: Dresser Industries, Inc., Dallas, Tex.

[21] Appl. No.: 561,849

[22] Filed: Dec. 15, 1983

[51] Int. Cl.[3] ..... E21B 43/112

[52] U.S. Cl. ..... 166/297; 175/4.56

[58] Field of Search ..... 166/297, 298, 381, 382, 166/387, 55, 55.1, 55.2, 120, 123, 125, 133; 175/4.52, 4.56; 285/138, 82, 83, 3, 4, 39, 102, 306

[56] References Cited

U.S. PATENT DOCUMENTS

| | | | |
|---|---|---|---|
| 2,304,408 | 12/1942 | Holifield | 175/4.56 |
| 4,078,611 | 3/1978 | Vann | 166/297 |
| 4,372,384 | 2/1983 | Kinney | 166/297 X |

*Primary Examiner*—Stephen J. Novosad
*Assistant Examiner*—Thuy M. Bui
*Attorney, Agent, or Firm*—Richard M. Byron

[57] ABSTRACT

A well perforating and completion apparatus includes a packer connectable to the lower end of a tubing string, a vent assembly connected below the packer for communication between the tubing string and the annulus, a well perforating gun assembly having a hydraulically actuatable detonator and a hydraulic actuating fluid flow path between the detonator and the earth surface. A releasable coupling is provided between the packer and the vent assembly to permit disconnecting and dropping of the vent assembly and perforating gun assembly from the tubing string after the perforation has been accomplished to leave an open ended tubing string in the well. The well perforation and completion method of this invention includes assemblying the tool string on the tubing string then running it into the well and positioned with the perforating gun and the packer at the desired location. The packer is set then the perforating gun fired by manipulating the hydraulic fluid pressure in the well through the hydraulic fluid flow path. Well production can then begin immediately through the vent assembly. Provided the perforating gun assembly is to be detached further manipulation of hydraulic pressure in the well or in an alternative mechanical manipulation of the coupling is used.

21 Claims, 4 Drawing Figures

WELL PERFORATING AND COMPLETION APPARATUS AND ASSOCIATED METHOD

TECHNICAL FIELD

This invention is related to completion of cased wells by using a tubing conveyed perforating and completion apparatus. More specifically this invention is related to a tubing conveyed perforation and completion apparatus for cased wells where hydraulic pressure is used in firing of the perforating gun and can be used to detach the perforating gun from the lower portion of the tubing string in a selective manner.

In the prior art tubing conveyed perforating devices were constructed so that firing of the perforating gun was accomplished by the dropping of a probe like actuator or a go devil through the tubing string from the earth surface to contact the detonator at the bottom of the tubing string for actuating the detonator. The use of such devices in the past has been quite adequate for substantially vertically disposed wells however they are not consistently acceptable for high deviated wells because of the tendency of the go devil to slow down and/or stop moving during its passage through the interior of the tubing string. When either or these conditions occur the go devil may not strike the detonator with sufficient force to actuate it or may never reach the detonator. When either condition occurs it may be necessary to fish the go devil from the tubing string and drop it again or pull the tubing string from the well either of which is a difficult and time consuming task.

One additional disadvantage in the prior art devices is that the dropping of a go devil through the tubing string results in one more piece of hardware being located within the bottom of the well bore that may have an influence on further performance and/or operations concerning the well. Additionally in some wells it is desirable to retain the perforating gun in place after it has been fired so that it functions as a defuser or blast joint for well fluids passing inward through perforations in the casing from the earth formations. In this circumstance the used perforating gun functions as a blast joint and suffers erosion from the incoming well fluids rather than such erosion being received by the interior of the well casing. In this operation production of fluids from the well is through the vent assembly located between the perforating gun and the packer. If a go devil is dropped through the tubing there is a possibility that it may become lodged or located at a point occluding openings of the vent assembly thus requiring its specific removal or other measures by quite possibly involving cutting of the tubing string below the packer requiring the well to be operated in an open ended tubing string configuration.

SUMMARY OF THE INVENTION

In an embodiment of the well perforating and completing apparatus of this invention a packer is provided for mounting on the lower end of a tubing string and connected by a releasable coupling to a vent assembly with a perforating gun assembly supported therebelow and connected by an auxiliary hydraulic fluid flow path to the earth surface. At the earth surface pressurizing equipment is used to set the packer and to fire the perforating gun detonator when desired. The releasable coupling can be actuated by manipulating pressures in the well once the perforating gun has been fired in order to drop the perforating gun from the tubing string thereby leaving an open ended tubing string in the well zone being produced.

In following the method of this invention the tool assembly or tool string is assembled at the earth surface as described immediately above then it is run into the well on the tubing string. The perforating gun and packer are positioned at a location that will enable the perforating gun to perforate the selected portion of the subsurface earth formations. The packer is set to secure the perforating gun and the tubing string in place. Before the perforating gun is fired an underbalanced condition is established by opening the vent assembly when the tubing string is dry or void of fluid. This condition can also be created by removing fluid from the tubing string when it is filled with fluid. Then pressure in the well annulus is manipulated to fire the perforating gun by activating its detonator. Once the perforating gun has been fired production from the selected zone can begin immediately with well fluids passing through the vent assembly and into the tubing string. Release of the releasable coupling can be done by tubing pressure manipulation or mechanical latch manipulation to disconnect the perforating gun and the vent assembly from the lower end of the tubing string in order to leave the tubing string with an open lower end.

One object of this invention is to provide a well perforating completion apparatus and associated method that overcome the aforementioned disadvantages of the prior art devices for methods of well completion.

Still, one other object of this invention is to provide a well perforating and completing apparatus that can be operated by hydraulic pressure thus being suitable for use in highly deviated boreholes where mechanical actuating systems for such devices occasionally encounter difficulty.

Another object of this invention is to provide a well perforating and completion apparatus for tubing conveyed well completion operations that is totally hydraulically controlled yet can be mechanically controlled and operated as a backup feature in the event of difficulties with the hydraulically operated apparatus.

Still it is another object of this invention to provide a method for perforating and completing wells using a tubing conveyed well perforating and completing apparatus whereby hydraulic pressure manipulation of the tubing string pressure and the casing annulus pressure are utilized to set the packer, to fire the perforating gun, and also, if desired to release the perforating gun and a vent assembly from the tubing string and provide an open ended tubing string to facilitate production of oil or gas from the well.

Various other objects, advantages and features of this invention will become apparent to those skilled in the art from the following discussion, taken in conjunction with the accompanying drawing, in which:

Figures 1, 2:
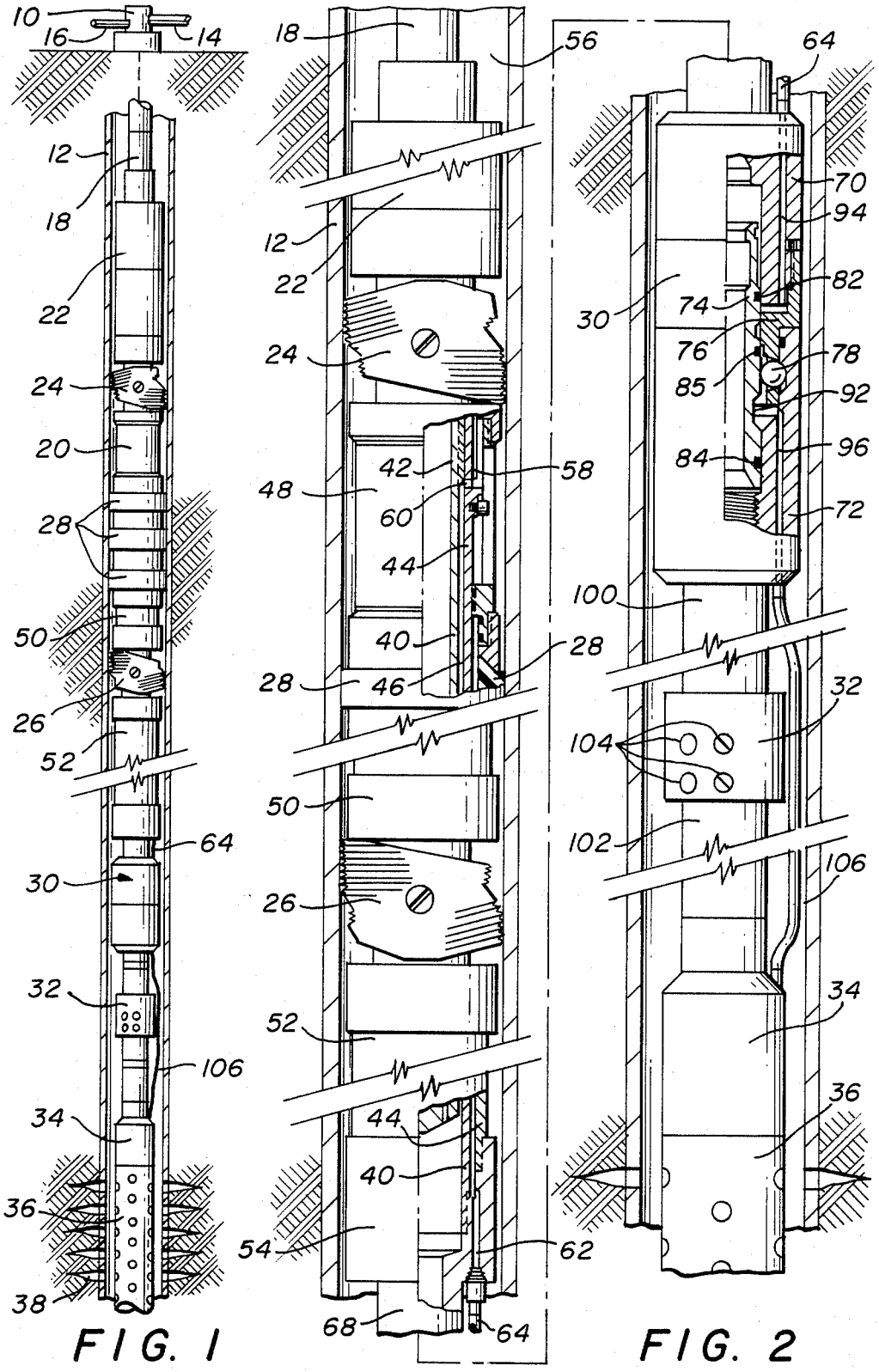
FIG. 1 is a cutaway view of a well perforating and completion apparatus of this invention installed in a well and supported from a wellhead with portions of the subsurface earth formations illustrating perforations thereof.
FIG. 2 is a shortened and cross sectional view of the well perforation and completion apparatus of this invention with portions of the packer and releasable coupling shown in cutaway.

The following is a discussion and description of preferred specific embodiments of the well perforating and completion apparatus and the associated method of this invention, such being made with reference to the drawings whereupon the same reference numerals are used to indicate the same or similar parts and/or structure. It is to be understood that such discussion and description is not to unduly limit the scope of this invention.

DETAILED DESCRIPTION OF THE PREFERRED EMBODIMENT

Referring to FIG. 1 such shows such a well having the tubing conveyed well perforation and completion apparatus of this invention installed therein. At the earth surface wellhead 10 is mounted with casing 12 and includes a tubing string connection conduit 14 and a well annulus connection conduit 16 providing separate fluid communication with these portions of the well. The tubing string as supported from wellhead 10 includes a plurality of segments of tubing joined to the upper end of packer 20.

Packer 20 is preferably a hydraulically settable through bore packer permitting open fluid communication between its upper and lower end connections in the tubing string. Packer 20 includes a latch seal nipple 22 at its upper end portion connecting the packer with the lowermost segment of tubing. Packer 20 has an upper slip 24, a lower slip 26 and a plurality of packing elements 28 mounted around an outer mandrel thereof between the slips. A releasable coupling 30 is connected below packer 20 and provides a releasable connection in the tool string of this well completion apparatus. A vent assembly 32 is connected below releasable coupling 30 and includes a plurality of openings to give open fluid communication between the interior of the tubing string and the isolated portion or zone of the well below packer 20.

A perforating gun assembly is supported below vent assembly 32 and includes a perforating gun firing head 34 mounted atop a perforating gun body 36. Perforating gun firing head 34 contains a detonator and primary explosives to operably ignite secondary explosives in the perforating gun components contained within perforating gun body 36.

A hydraulic fluid flow path is established between firing head 34 and the earth surface by passageways and chambers in the well perforating and completion apparatus and through portions of the well above packer 20 in order that pressures in the well can be manipulated to activate the detonator in firing head 34 and also to activate the latch mechanism in releasable coupling 30.

Referring to FIG. 2 portions of the packer and the releasable coupling are shown cutaway to expose portions of the auxiliary hydraulic fluid flow path. Packer 20 is preferably a type of packer referred to as a hydraulic set through bore packer. This packer is settable in the well casing 12 by either hydraulic pressure manipulations or by using an optional mechanical setting procedure. Packer 20 includes an inner mandrel 40 with a bore 42 therethrough providing fluid communication longitudinally through its interior that is in line with the opening of the tubing string upon which the packer is mounted. An outer mandrel 44 is positioned over a segment of inner mandrel 40 between packer slips 24 and 26. An annular cavity or passageway 46 is formed between these inner and outer mandrels. A packer upper seal compression sleeve 48 is positioned around outer mandrel 44 and between packer seal rings 28 and upper slip 24. A packer lower seal compression sleeve 50 is positioned between packer seal rings 28 and lower slip 26. A packer extension 52 is located below lower slip 26 and terminates at packer bottom connection 54. Packer bottom connection 54 has inner mandrel 40 and outer mandrel 44 mounted therewith in a sealed relation. Inner mandrel 40 and outer mandrel 44 include a plurality of segments forming each of these members as they extend through packer extension 52 and portions of the packer between the slips. Packer extension 52 contains a portion of the packer mechanism that forms an optional mechanical apparatus usable to release the packer by a mechanical manipulation if desired.

The auxiliary hydraulic fluid path through packer 20 has an upper inlet between outer mandrel 44 and the interior of upper compression sleeve 48 exposed to fluid pressure in well annulus 56 above the packer and between the tubing string and the interior of casing 12. The inlet to this auxiliary hydraulic fluid flow path is at an inlet chamber 58 in the upper portion of packer upper seal compression sleeve 48. This inlet chamber 58 is annular in shape and connects with a port 60 through outer mandrel 44 communicating the fluid with annular passageway 46 between inner mandrel 40 and outer mandrel 44. This passageway extends downward through packer 20 to packer bottom connection 54 where it joins a passageway 62 in this bottom connection communicating to an external port on the lower end of bottom connection 54. A hydraulic line 64 is connected to this port and extends to releasable coupling 30. With packer 20 in the set position as shown in FIGS. 1 and 2 of the drawing this auxiliary hydraulic fluid flow path is open to provide open fluid communication between well annulus 56 through wellhead 10 from the well perforating and completion apparatus to the earth surface.

If desired the auxiliary hydraulic fluid path between packer 20 and the earth's surface equipment can be established by using an auxiliary conduit. In this construction an auxiliary hydraulic fluid path inlet port would be provided on packer 20 and this port connected by a special conduit other than tubing string 18 to wellhead 10 at the earth's surface. This conduit would be connected to pressurizing equipment at the earth's surface to specifically pressurize this auxiliary hydraulic fluid path for operation of the hydraulically operable detonator and releasable coupling 30.

Releasable coupling 30 is suspended below packer 20 in a depending relation by sub 68 mounted with packer bottom connection 54. Releasable coupling 30 includes an upper member 70 and a lower member 72 joined by a latch mechanism. This coupling is shown in detail in FIG. 3 in a coupled position and in FIG. 4 in a released and separated position. The latch mechanism includes a generally tubular latch member 74 located in the center portion of the coupling, a locking ball support sleeve 76 and a plurality of locking balls 78. Locking balls 78 are individually positioned within a plurality of apertures through a lower skirt of locking ball support sleeve 76 as shown. In this arrangement the locking balls are arranged in a ring like formation. When the coupling is in the connected position shown in FIG. 3 a peripheral portion of each of the individual locking balls 78 in this ring of balls is positioned within a groove 80 opening into the interior of lower coupling member 72. The mid portion of the individual balls is contained within the apertures of the ball support sleeve skirt. The inner peripheral portion of this ring of balls is in contact with an external surface of latch member 74. Because ball locking support sleeve 76 is threadedly mounted to upper member 70 a wedging action on the locking balls retains the lower member 72 in a depending and latched relation to upper member 70. To prevent fluid leakage past latch member 74 upper and lower seal rings 82 and 84 are provided around the outer periphery of latch member 74.

Figure 3:
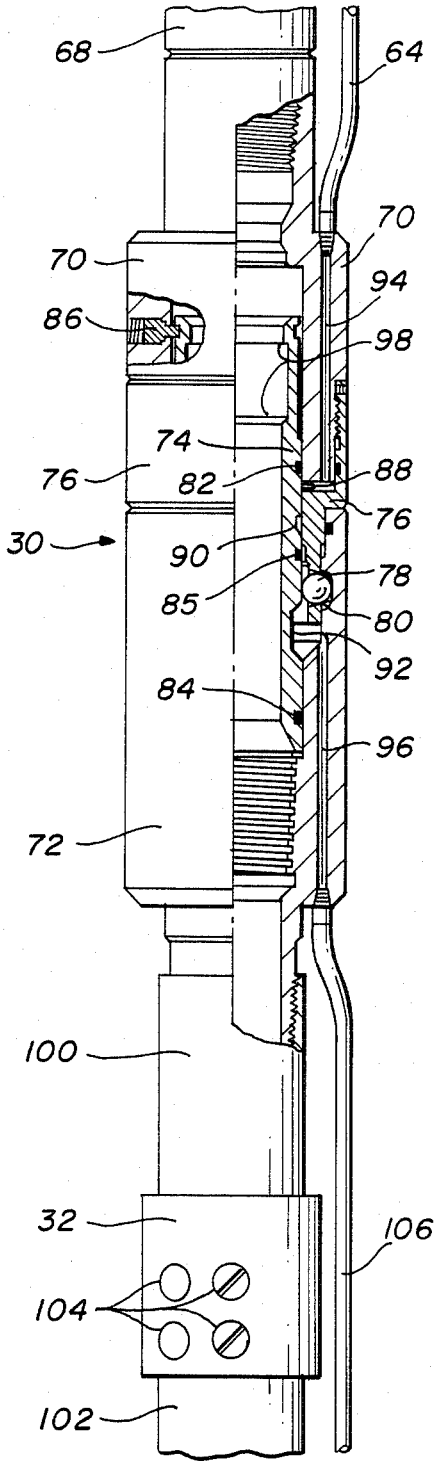
FIG. 3 is a cutaway elevation view of the releasable coupling and vent assembly and the adjoining segments of the tubing string.
Figure 4:
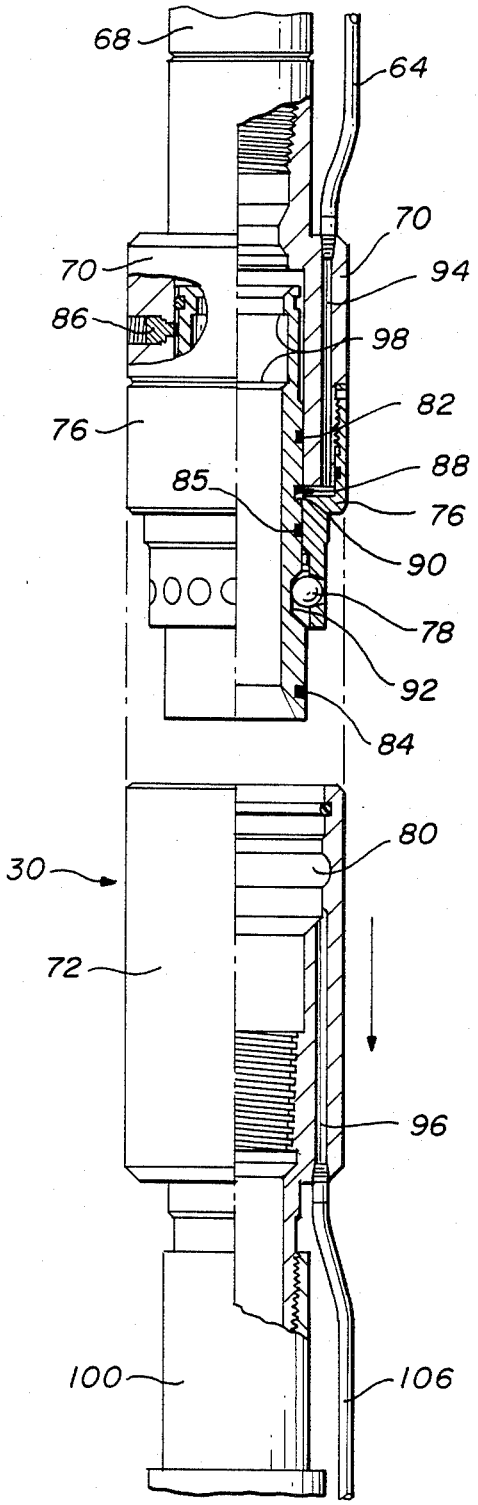
FIG. 4 is an exploded cutaway elevation view of the releasable coupling in a separated condition.

Within the upper portion of coupling upper member 70 a shear pin 86 is mounted with a shearable tip extending into an annular groove around the exterior of latch member 74. Shear pin 86 retains latch member 74 in the lower or latched position as shown in FIG. 3 until it is moved upward with sufficient force to shear the tip from shear pin 86. A retainer ring 88 is mounted around an upper portion of latch member 74 in an annular space formed between the lower end of upper member 70 and an upwardly facing abutment of locking ball support sleeve 76. Retainer ring 88 is constructed so as to be compressively retained on the exterior of the latch member in a spring like fashion so that when latch member 74 is moved upward to the position shown in FIG. 4 this ring will fall into a retainer ring groove formed around the exterior of latch member 74. With retainer ring 88 positioned in groove 90 as shown in FIG. 4 latch member 74 will be retained in its raised position. When this occurs locking balls 78 will be positioned as shown in FIG. 4 residing partially within a locking ball catching groove 92 around the lower peripheral portion of latch member 74 and partially within their respective apertures.

The auxillary hydraulic fluid path connections through releasable coupling 30 include an upper hydraulic passageway 94 through upper member 70 communicating to the annular space between the upper member and locking ball support sleeve 76. Fluid communication is established between the exterior of latching member 74 below seal ring 82 and the interior of locking ball support sleeve 76 and downward therefrom through facing portions of the latch member and the interior of lower member 72. This fluid path is bounded by seal ring 84 and its contact with an internal seal surface in lower member 72 as shown in FIG. 2. A lower passageway 96 joins this annular fluid passageway above seal ring 82 and is provided with a port at the lower end portion of lower member 72.

Fluid pressure operation of the coupling latch mechanism is done by raising the tubing pressure. In order to raise the tubing pressure fluid flow below coupling 30 through the tubing must be block. This can be done in several ways depending upon the specific vent assembly used. When the vent assembly has a check valve, that will suffice to block pressure in the tubing string. If a permanently open vent assembly is used, then a sealing ball can be dropped in the tubing to seat on a ball catching ring at or above the vent assembly (not shown) as is well know in subsurface oil well tool manipulations. Once this blocking has occurred, then coupling 30 is ready to be disconnected. As pressure in the tubing is increased, this creates a differential pressure on latch member 74 displacing it in the upward direction because the diameter of the sealed connection at seal ring 82 is smaller than the diameter of the seal connection at seal ring 84. This size relationship creates a pressure driven piston effect on latch member 74 displacing it in the upward direction from the position shown in FIG. 3.

The specific pressure needed to release coupling 30 is in excess of that required for setting the packer so that setting of the packer does not cause a premature release of the coupling. For a packer that is set at 3,000 psi, a pressure to release the coupling of 4,000 psi has been found adequate. When the pressure is sufficient to shear the tip from shear plug 86 latch member 74 is moved upward to the position shown in FIG. 4 whereupon retainer ring 88 slips into groove 90 holding the latch member in the raised position. As latch member 74 moves upward locking balls 78 are free to move radially inward into their associated locking ball recesses or the groove 92 around the lower portion of the latch member where they are retained as shown in FIG. 4. As this occurs the retaining support for releasable coupling lower member 72 is removed and this member along with the structure of the perforating gun body, firing head, connecting subs and vent assembly drop into lower portions of the well. Because tubing pressure is applied to the perforating gun, this provides a pressure assisted force to displace or push lower portions of coupling 30 downward from the tubing string. This leaves the tubing string an open ended configuration.

In conjunction with upward movement of latch member 74 the auxiliary hydraulic fluid path is blocked to prevent fluid from well annulus 56 from communicating with the production zone. In order to seal off or block this fluid path seal ring 85 around latch member 74 cooperates with seal ring 82 to block fluid communication through an annular space connecting to upper passageway 96 as shown in FIG. 4.

Also, it is to be noted that latch member 74 is provided with an internal latching recess or profile 98. This recess or profile construction is preferably done in accordance with teachings of the well tool manipulation art for shifting sleeves, latches and other mechanical devices. This profile is provided within the interior of latch member 74 so that in the event of a failure in the hydraulic system then a latching or shifting tool could be inserted through the tubing string and connected into profile for the purpose of raising it to the upper or released position for disconnecting the releasable coupling and dropping the suspended gun body and other connected devices.

Vent assembly 32 is connected to releasable coupling 30 in a depending fashion by connecting sub 100. Vent assembly 32 has another connecting sub 102 connected thereto and in depending fashion and joining the upper end of perforating gun firing head 34. Vent assembly 32 is a perforated nipple having a plurality of openings 104 providing fluid communication between the well annulus and the interior of the tubing string as defined at that location by the adjoining connecting subs 100 and 102. It is to be noted that the vent assembly can be of a type that includes a perforated nipple with check valves incorporated into the openings between the well annulus and the tubing string. In such a vent assembly the check valves would permit the flow of well fluids from the well annulus into the tubing string and such valves would prevent flow in the reverse direction. Vent assembly 32 can also be of a well known construction that includes a valve or the like for keeping the openings closed until it is opened by using a mechanical shifting tool or the like or an explosive type actuator.

The perforating gun firing head 34 is provided with a fluid entrance port from hydraulic line 106 and communicating the fluid of this flow path to a hydraulically actuatable detonating mechanism. This detonating mechanism is not shown in detail because it can be any of several known mechanisms that will accomplish the defined purpose. Such a detonator must be actuatable by an increase of fluid pressure to detonate a primary explosive in a chain of explosives that will in turn cause the charges of the perforating gun to be ignited for the purpose of perforating the well casing and the adjacent subsurface earth formations. Preferably the mechanism of perforating gun firing head 34 is constructed so that it can be actuated by the preferred hydraulic procedure and alternately in a backup mode of operation it be detonated by other mechanical procedures. In one such procedure an auxiliary detonator is lowered through the tubing string and placed in contact with elements within the firing head then detonated to achieve the desired detonation. In another such procedure the firing head is detonated by dropping a go devil or the like through the tubing string to contact an explosive actuator to detonate the primary explosive element.

Turning to the method of operation of the well perforating and completion apparatus of this invention a tool string including the packer, the releasable coupling, the vent assembly and the perforating gun assembly including the firing head and the perforating gun body are assembled at the earth surface and attached to segments of tubing and the entire assembly is then lowered into the well. Successive segments of tubing are connected forming the generally described tubing string until the perforating gun and the packer are positioned in the desired location so that when the perforating gun is fired the resulting perforations in the casing and earth formation will be into the zone that has been selected for production. In final positioning of the perforating gun a gamma ray detector instrument and a casing collar locator may be used as is well known in the art of completing oil and gas wells in order to locate the desired location at which the perforating gun should be positioned to properly locate the perforations.

Once this has been done packer 20 is set to secure the tubing string and its components in a substantially fixed place within well casing 12. Setting of the packer is accomplished by pressurizing the tubing string when the valve type vent assembly is used. When pressure is applied to the tubing string it is contained within the tubing string and within the packer so that the packer's internal hydraulic setting mechanism causes the slips to be rotated to the position shown and engaged with the well casing. In typical operations for setting such packers, a tubing pressure of 3,000 psi is needed to generate the forces needed to set the packer and pack off or seal it in the well casing. At this time the packer seal elements 28 are also engaged in sealing relation between the packer's outer mandrel and the casing interior so the packer assumes the position shown in FIGS. 1 and 2.

In installations where vent assembly 32 is not of the type having a valve assembly then a plugging ball or tubing string plugging device is dropped into the tubing string at the earth surface and falls to a mechanical stop or no-go immediately above the vent assembly openings so that fluid pressure can be applied to the tubing string and contained therein to achieve setting of the packer. Additionally, for installations where a hydraulically settable packer is not desirable or for some reason not feasible a mechanical setting packer can be used provided that is equipped with an equivalent auxiliary hydraulic flow path operably equivalent to that in the packer shown and described herein. In such instance the packer would be mechanically set by tubing manipulation or the use of an auxiliary setting device run through the tubing string and engaged with appropriate actuating components of the packer.

Once the packer has been set in the desired location it divides the well into a lower zone below the sealing members of the packer and an upper zone, between the packer and the earth surface. Next an underbalanced pressure condition must be established between the tubing string and pressure in the subsurface earth formations outside of the casing wherein the tubing string pressure is the lower pressures. For tool strings having a valve in the vent assembly the tubing string is run into the well dry with the valve closed this valve is merely opened and the below packer pressure in the well is merely opened and the below packer pressure in the well becomes substantially equal to atmospheric pressure. In tool strings having a permanently open vent assembly this pressure condition is accomplished by swabbing the tubing string or any other appropriate substitute method for removing residue drilling fluids or other fluids that may be in the tubing string and in the well's production zone below the packer. When this condition is achieved the fluid pressure within the well below the packer and in the tubing string will be substantially less than the fluid pressure in the subsurface earth formation zone immediately surrounding the perforating gun.

In order to fire the perforating gun fluid pressure in the well annulus 56 is increased and accordingly the fluid pressure is increased through the auxiliary hydraulic fluid flow path is increased. When this pressure reaches a predetermined value the hydraulically actuatable detonating mechanism functions as designed and detonates the primary explosives, this in turn detonates other explosives causing the perforating gun to be fired and perforations to be made through well casing 12 and into the surrounding subsurface earth formations. The specific pressure required for actuating the detonating mechanism can be a nominal amount of 1,000 psi or less.

Once the perforations have been formed then production from the perforating zone can begin immediately with the produced well fluid flowing through the openings of vent assembly 32 and into the tubing string. If it is desired to leave the perforating gun body 36 in place in the well to function as a blast joint or the like and reduce abrasion and degradation of the casing's interior it may be left in place with releasable coupling remaining in tact as shown in FIG. 1.

In the event that it is desired to drop perforating gun body 36, firing head 34, and vent assembly 32 from the tubing string and produce the well through an open ended tubing string then releasable coupling 30 can be actuated to cause these portions of the perforating apparatus to be dropped into the rat hole or lower portion of the well. In order to accomplish separation of releasable coupling 30 the well tubing string 18 is pressurized to a value required for hydraulic movement of latch member 74 as described above. Construction of the latch assembly in releasable coupling 30 is such that pressure increased in this manner will cause shifting of the latch member 74 from its secured position to a released position with the latch member raised in order to separate the upper and lower members of releasable coupling 30. If for some reason the hydraulic releasing operation of releasable coupling 30 cannot be accomplished then the interior of latch member 74 is constructed to be grasped by a manipulating tool that is lowered into the tubing string at the earth surface, engaged with the latch and pulled upward for releasing the latch mechanism as described in detail above.

Once releasable coupling has been unlatched the lower member 72 will drop away from upper member 70 due to fluid pressure forces from the pressurized tubing string and the weight of the perforating gun and the attached components. It is desirable for the perforating gun and its attached components to be displaced some substantial distance from the remaining coupling element in order to prevent blockage of the tubing string with the detached coupling element and to facilitate well servicing at a later date. When this occurs the tubing string will be completely open and facilitate a free flow of produced well fluids from the subsurface earth formations, and through perforations in the casing so the well fluid may flow to the earth surface through the interior of the tubing string to the wellhead.

As will become apparent from the foregoing description of the applicant's well perforating and completion apparatus and its associated method. The system is relatively simple and provides an apparatus and a method or technique for performing tubing conveyed well perforations and completions in wells that have highly deviated boreholes or in other wells where hydraulically actuated perforating is desirable.

Although specific preferred embodiments of this invention have been described in detail in the preceding description it is not intended to limit the invention to the particular form or embodiments disclosed herein since they are to be recognized as illustrative rather than restrictive and it would be obvious to those skilled in art that the invention is not so limited. For example, in the description the packer is referred to as being mechanically settable as well as hydraulically settable and the vent assembly is described as being inclusive of a check valve, a sleeve type valve and open without a valve. Thus the invention is declared to cover all changes and modifications of the specific example of the invention herein disclosed for purposes of illustration which does not constitute departing from the spirit and scope of the invention.

The embodiments of the invention in which an exclusive property or privilege is claimed are defined as follows:

1. A perforating and completing apparatus, including:

(a) a packer connectable to the lower end portion of a tubing string in a well bore providing fluid communication for well fluids through an inner passageway;

(b) a disconnectable hollow coupling connected in fluid communication with said tubing string and below said packer;

(c) a tubing vent assembly connected in fluid communication with said tubing string and mounted in depending relation to said disconnectable coupling;

(d) a well perforating gun assembly mounted in the depending relation with said tubing vent assembly and including a hydraulically operable detonator mounted with a perforating gun thereof; and (e) an auxiliary hydraulic fluid path connectable to a source of fluid pressure at an earth surface location at a well to said hydraulically operable detonator in order to communicate hydraulic fluid pressure to said detonator for actuating said detonator.

2. The apparatus of claim 1, wherein:

said auxiliary fluid path has a fluid channel through said packer.

3. The apparatus of claim 2, wherein:

said packer has an inlet to said auxiliary hydraulic fluid path from the well annulus above the packer seal elements and an outlet at a lower portion of said packer below said seal elements.

4. The apparatus of claim 2, wherein:

said packer has an inlet to said auxiliary hydraulic fluid path in fluid communication with the flow path established within the interior of said casing, and an outlet at a lower portion of said packer below the seal element thereof.

5. The apparatus of claim 1, wherein:

said auxiliary hydraulic fluid path has a fluid flow channel through said coupling.

6. A well perforating and completing apparatus including:

(a) a packer connectable in the lower end portion of a tubing string in a well bore providing open fluid communication for well fluids through an inner passageway thereof and having an auxiliary fluid path between an inlet in communication with the well annulus above and uppermost packer sealing element and an auxiliary fluid path outlet port on a lower portion of said packer;

(b) a disconnectable hollow coupling connectable in fluid communication with said tubing string below said packer and having an upper member connected to said packer and a lower disconnectable member joined thereto in depending relation, said coupling including a segment of said auxiliary fluid path with an inlet on said upper member and an outlet on said lower disconnectable member;

(c) a tubing vent assembly connected in fluid communication with said tubing string and mounted in depending relation to said disconnectable coupling lower disconnectable member;

(d) a well perforating gun assembly connected to said tubing vent assembly and mounted in depending relation thereto and including a hydraulically operable detonator mounted with an earth formation well perforating gun; and (e) an auxiliary hydraulic path from said packer auxiliary outlet port, through said coupling and to said hydraulically operable detonator in order to communicate well annulus fluid pressure above said packer to said hydraulically operable detonator for actuating said detonator.

7. The apparatus of claim 6, wherein said packer has:

(a) an outer tubular mandrel around which a packing element is mounted;

(b) an inner tubular mandrel mounted within said outer mandrel and in fluid communication with said tubing string;

(c) a port in said outer tubular mandrel providing fluid communication between a zone surrounding said outer mandrel and an annular cavity between said outer mandrel and said inner mandrel member; and (d) an outlet from said annular cavity at a lower portion of said packer forming an auxiliary hydraulic fluid path outlet.

8. The apparatus of claim 7, wherein said disconnectable coupling additionally includes:

(a) a hollow tubular upper member connected in fluid communication and in depending relation to said packer;

(b) a hollow tubular lower member connected in fluid communication with said upper member;

(c) a latching mechanism joining said upper and said lower coupling members together in a connected operable relation said latching mechanism being actuatable by hydraulic pressure to release said upper and lower coupling members; and (d) an auxiliary hydraulic fluid path segment including an inlet on said upper coupling member, an outlet on said lower coupling member, and a fluid flow path therebetween.

9. The apparatus of claim 7, wherein said disconnectable coupling includes:

(a) a latch mechanism with a locking member retained in a wedged position between facing portions of upper coupling member and said lower coupling member by a latch member, (b) said latch member being movable from a first position retaining said locking member in said wedged position to a second position releasing said locking member from said wedged position; and (c) said latch member having a hydraulic force pressure area thereon exposed to hydraulic fluid pressure in said tubing string such that pressure in said tubing string will urge said latch member toward said second position.

10. The apparatus of claim 9, wherein:

(a) said upper coupling member has a tubular skirt on a lower portion thereof with a plurality of spaced apart apertures therethrough, (b) said lower coupling member has a groove around the interior of an upper portion thereof generally aligned with said apertures and overlying the exterior of said upper coupling member tubular skirt, when said coupling is connected;

(c) said latch member is positioned within said lower coupling member with a tubular segment generally aligned with said apertures and having a groove therearound opening to the outer periphery of said tubular segment below said apertures when said coupling members are connected; and (d) a locking ball is mounted in each of said apertures and in contact with facing surfaces of said upper and lower coupling members at said apertures in order to retain said coupling members in a fixed relation to one another.

11. The apparatus of claim 10, wherein:

(a) said hydraulic fluid path segment in said disconnectable coupling has a hydraulic pressure chamber defined by adjacent surfaces of said latch member, said upper coupling member and said lower coupling member;

(b) said hydraulic force pressure area is defined on said latch member between an upper seal ring residing in contact with said upper coupling member and a larger diameter lower seal ring residing in contact with said lower coupling member and said force pressure area being exposed to hydraulic pressure inside of the fluid passageway of said tubing string such that increased fluid pressure therein urges said latch member toward said second position.

12. The apparatus of claim 10, wherein:

(a) said latch member is tubular with a manipulating tool grasping profile formed within the interior thereof for temporarily connecting with a manipulating tool that is temporarily disposed in a tubing string in which said well perforating and completing apparatus is installed for the purpose of displacing said latch member; and (b) said latch member has a plurality of seals around the exterior thereof positioned to establish a fluid tight seal with said upper coupling member and said lower coupling member and forming a portion of said auxiliary hydraulic fluid path with said latch member in a latched position connecting said coupling members, said plurality of seals being positioned to block said auxiliary hydraulic fluid path at said coupling upper member with said latch member in a raised position and said coupling members being disconnected.

13. A system for perforating and completing a well consisting of an earth borehole with casing secured therein, comprising:

(a) a wellhead mounted with said casing at the earth surface and suspending within the casing a tubing string and having ports at the wellhead for fluid communication with the interior of the tubing string and with the well annulus surrounding the tubing string within the casing;

(b) a packer connected to the lower end of said tubing string and set within said casing to isolate said casing into a lower zone and an upper zone and provide fluid communication from said lower zone into said tubing string;

(c) a disconnectable hollow coupling connected in depending relation to said packer with the interior thereof in fluid communication with said tubing string;

(d) a tubing vent assembly connected in depending relation to said coupling and in fluid communication with said tubing string and providing for communication of produced well fluids from said lower zone into said tubing string;

(e) a well perforating gun assembly mounted in depending relation from said tubing vent assembly and including a hydraulically operable detonator; and (f) an auxiliary hydraulic fluid path from said hydraulically operable detonator to the earth surface within the confines of said casing and operable to transfer hydraulic pressure from a location at the earth surface to said detonator for actuating same and in turn firing said perforating gun assembly for perforating said earth formations and said casing.

14. The system of claim 13, wherein:

(a) said packer has a hollow outer tubular mandrel around which a packing element is mounted;

(b) an inner tubular mandrel mounted within said outer mandrel and in fluid communication with said tubing string;

(c) a port in said tubular outer mandrel provides fluid communication between a zone surrounding said outer mandrel above said packer and an annular cavity between said outer mandrel and said inner tubular mandrel; and (d) an outlet from said annular cavity at a lower portion of said packer forming an auxiliary hydraulic fluid path outlet.

15. The system of claim 14, wherein:

(a) said coupling has a hollow tubular upper member connected in fluid communication with a tubing string at the outlet of said packer;

(b) a hollow tubular lower member connected in fluid communication with said upper member and said vent assembly;

(c) a latching mechanism joining said upper and said lower coupling members, said latching mechanism being releasable by hydraulic pressure applied to said auxiliary hydraulic fluid path; and (d) an annular hydraulic fluid path including an inlet on said upper member, an outlet on said lower member, and a fluid flow path therebetween.

16. The system of claim 15, wherein:

(a) said latching mechanism includes a latch member located in a first position to prevent movement of locking members operably securing said upper and lower coupling members together and being exposed to pressure from the interior of said tubing string such that fluid pressure in said tubing string above a predetermined value will displace said latch member to a second position releasing said locking members to facilitate separation of said upper and lower coupling member; and (b) said latching mechanism has a seal assembly means operable in association with said latch member to block said auxiliary hydraulic fluid path upon movement of said latch member to release said coupling members.

17. A method of completing a well includes the steps of:

(a) assembling a subsurface well completion tool assembly including a packer with an opening therethrough, a releasable coupling dependent from the packer, a vent assembly depending from the releasable coupling for providing open fluid communication between a connected tubing string and the well interior and a perforating gun assembly suspended from the vent assembly and having a hydraulic pressure actuatable detonator assembly;

(b) connecting the completion tool assembly to the lower end of a tubing string;

(c) running the tubing string in a well to a subsurface location;

(d) positioning the completion tool assembly at a location selected for perforating the subsurface earth formation;

(e) setting the packer;

(f) firing the perforating gun by manipulating fluid pressure in the well in order to cause operation of the hydraulic pressure actuated Perforating gun detonator assembly in order to accomplish perforation of the subsurface earth formation surrounding casing of the well at that location;

(g) disconnecting the perforating gun from the completion tool assembly and dropping the perforating gun into a lower portion of the well by hydraulic manipulation by fluid pressure in the tubing string to release a latching mechanism of the releasable coupling; and (h) beginning production of well fluids from the well zone perforated into said tubing string and to the earth's surface following said firing the perforating gun.

18. The method of claim 17, additionally including after said setting the packer then a step of performing a step of achieving an underbalanced well condition wherein pressure in the tubing string and pressure in connected fluid cavities of the well are adjusted to a fluid pressure below that of earth formations in the zone thereof to be perforated.

19. The method of claim 17, wherein said step of disconnecting includes mechanically operating said releasable coupling by mechanically manipulating a latch mechanism thereof from within the tubing string in the event of inability to achieve said disconnection by hydraulic manipulation.

20. A method of completing a well including the steps of:

(a) causing a well perforation and completion tool assembly to be run into a cased well on a tubing string where the tool assembly includes a packer mounted on the lower end of a tubing string, a vent assembly mounted below the packer to provide fluid communication between the well annulus and the tubing string, a releasable coupling interposed between said packer and said vent assembly and a perforating gun assembly mounted below the vent assembly and including a hydraulic pressure actuatable detonator assembly;

(b) positioning the perforating gun assembly at a selected location for perforating the surrounding earth formation;

(c) setting the packer;

(d) firing the perforating gun by causing hydraulic pressure to be applied to the hydraulic pressure actuatable detonator assembly;

(e) disconnecting said perforating gun assembly from said tubing string by temporarily increasing fluid pressure in said tubing string such that a pressure actuatable mechanism in the releasable coupling leaving the tubing string in an open ended configuration; and (f) producing well fluids from the well zone perforated through the tubing string.

21. The method of claim 20, wherein:

said causing a well perforation and completion tool assembly to be run into a cased well includes the step of maintaining said tubing string in a dry condition such that after said setting the packer a significant differential pressure will be present between the tubing string interior and the earth formation to be perforated.

* * * * *